US008336788B2

(12) United States Patent
Perkins et al.

(10) Patent No.: US 8,336,788 B2
(45) Date of Patent: Dec. 25, 2012

(54) DRIPLESS ROTARY SPRINKLER AND RELATED METHOD

(75) Inventors: Lee A. Perkins, Lowden, WA (US); Craig B. Nelson, Walla Walla, WA (US); Christina R. Butler, Clarkston, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 631 days.

(21) Appl. No.: 12/537,690

(22) Filed: Aug. 7, 2009

(65) Prior Publication Data

US 2011/0031325 A1 Feb. 10, 2011

(51) Int. Cl.

| | |
|---|---|
| ***B05B 1/28*** | (2006.01) |
| ***B05B 15/04*** | (2006.01) |
| ***B05B 3/00*** | (2006.01) |
| ***B05B 15/06*** | (2006.01) |

(52) U.S. Cl. ..... 239/122; 239/288.5; 239/124; 239/210

(58) Field of Classification Search ..... 239/273, 239/282, 283, 288.5, 124–125, 222.17, 222.11, 239/DIG. 11, 222.13, 200–207, 210, 7, 120, 239/121, 122, 104

See application file for complete search history.

(56) References Cited

U.S. PATENT DOCUMENTS

| | | | | |
|---|---|---|---|---|
| RE7,705 | E * | 5/1877 | Essex | 239/121 |
| 1,020,937 | A | 3/1912 | Warwick | |
| 1,653,809 | A | 12/1927 | Lane | |
| 1,831,603 | A * | 11/1931 | Macomber | 239/122 |
| 1,863,914 | A | 6/1932 | Tyler | |
| 1,989,013 | A * | 1/1935 | Levene | 239/122 |
| 3,791,582 | A | 2/1974 | Mencacci | |
| 4,198,000 | A | 4/1980 | Hunter | |
| 5,224,653 | A | 7/1993 | Nelson et al. | |
| 5,241,978 | A | 9/1993 | Shaw et al. | |
| 5,553,786 | A | 9/1996 | Israel | |
| 5,730,365 | A | 3/1998 | Messinger | |
| 6,000,634 | A | 12/1999 | Mehoudar | |
| 6,651,904 | B2 | 11/2003 | Roman | |
| 6,899,287 | B2 * | 5/2005 | Pinch et al. | 239/380 |
| 7,287,710 | B1 * | 10/2007 | Nelson et al. | 239/222.17 |
| 8,028,934 | B2 * | 10/2011 | Wurz et al. | 239/434 |
| 2008/0054093 | A1 * | 3/2008 | Nelson et al. | 239/222.21 |

* cited by examiner

*Primary Examiner* — Len Tran
*Assistant Examiner* — Justin Jonaitis
(74) *Attorney, Agent, or Firm* — Nixon & Vanderhye, P.C.

(57) ABSTRACT

A rotary sprinkler includes a housing supporting a nozzle and a nozzle tube, the nozzle tube located axially adjacent an orifice of the nozzle with an axial gap therebetween. A water-deflection plate assembly is carried by the nozzle tube for rotation relative to the nozzle tube. The housing is formed with an exterior substantially annular funnel surrounding the nozzle and forming a collection trough for collection of excess water, and the housing formed with one or more apertures directing excess water in the collection trough to an internal area surrounding the orifice to be aspirated through the gap into a stream of water emitted from the nozzle orifice and through the nozzle tube such that the excess water is distributed by the water-deflection plate along with water emitted from the nozzle orifice.

20 Claims, 11 Drawing Sheets

DRIPLESS ROTARY SPRINKLER AND RELATED METHOD

This invention relates generally to sprinklers used in agricultural irrigation applications, and more specifically, to sprinklers which emit a stream from a stationary nozzle onto a rotating water-deflection plate.

BACKGROUND OF THE INVENTION

Rotating sprinklers used in agricultural irrigation are often configured to include a stationary nozzle that emits a stream onto a rotating water-deflection plate formed with one or more generally radially-oriented grooves that serve to redirect the stream radially outwardly in a desired pattern. Typically, the plate is supported on one or more support struts fixed to and extending from the sprinkler body, so that the stream or streams thrown outwardly by the water-deflection plate must rotate past the support struts. This arrangement has two disadvantages. One is that the struts cause dry areas in the sprinkling pattern, and the other is that the water striking the support struts drips off the sprinkler and pools in the area directly beneath. Thus, depending on the specific operating parameters, the sprinkler may underwater in some areas and overwater in others, degrading overall performance.

It is also by now a conventional practice to use rotating sprinklers with braking mechanisms that retard the rotation of the water-deflection or distribution plate in order to maximize the throw radius of the sprinkler by eliminating the "horse-tail" effect prevalent with free-spinning sprinklers. In some instances, this arrangement can exacerbate the problems noted above due to the slower rotation of the water-deflection plate. In addition, thrust loading on internal components can cause excessive mechanical friction, possibly leading to reduced service life.

There remains a need, therefore, for a braked sprinkler with enhanced performance and a sprinkler that eliminates or at least substantially minimizes drool or drip-off.

BRIEF DESCRIPTION OF THE INVENTION

In one exemplary but nonlimiting embodiment, the invention relates to a rotary sprinkler comprising a housing supporting a nozzle and a nozzle tube, the nozzle tube located axially adjacent an orifice of the nozzle with an axial gap therebetween; a water-deflection plate assembly carried by the nozzle tube for rotation relative to the nozzle tube; wherein the housing is formed with an exterior substantially annular funnel surrounding the nozzle and forming a collection trough for collection of excess water, the housing formed with one or more apertures directing excess water in the collection trough to an internal area surrounding the orifice to be aspirated through the gap into a stream of water emitted from the nozzle orifice and through the nozzle tube such that the excess water is distributed by the water-deflection plate along with water emitted from the nozzle orifice.

In another exemplary but nonlimiting embodiment, the invention relates to a rotary sprinkler comprising a housing supporting a nozzle and a nozzle tube, said nozzle tube located axially adjacent an orifice of said nozzle; a water-deflection plate assembly carried by said nozzle tube for rotation relative to said nozzle tube; wherein said water-deflection plate assembly includes a support mounting a water-deflection plate at one end thereof, an opposite end of said support rotatably secured on said nozzle tube; and further wherein said support is rotatably secured on said nozzle tube by a ball-bearing assembly located in a chamber radially between said nozzle tube and said support, wherein said ball-bearing assembly comprises a first race fixed to said nozzle tube and a second race fixed to said support for rotation therewith; a plurality of bearing balls located between said first and second races, said first and second races having ball-engaging surfaces aligned at an acute angle to vertical; a pair of seals at opposite ends of said ball-bearing assembly.

In still another exemplary but nonlimiting embodiment, the invention relates to a rotary sprinkler comprising a sprinkler body; a nozzle and an adjacent nozzle tube upstream of said nozzle enclosed within said sprinkler body; a rotatable water-deflection plate carried by said sprinkler body; a cap assembly removably attached to said sprinkler body, said cap assembly incorporating means surrounding said nozzle tube for slowing a rotational speed of said spray plate, said cap assembly further including an annular radial flange provided with one or more drainage holes for directing excess water through said housing and onto said water-deflection plate thereby enabling the excess water to be distributed by said water-deflection plate along with water emitted from the nozzle.

In still another exemplary but nonlimiting aspect, the invention relates to a method of redirecting excess water on a sprinkler housing comprising collecting excess water running down an exterior surface of the sprinkler housing; causing the excess water to follow predetermined paths into an interior portion of the housing; and directing the excess water into a nozzle stream emitted from a nozzle supported on the sprinkler housing.

The invention will now be described in greater detail in connection with the drawing figures identified below:

DETAILED DESCRIPTION OF THE DRAWINGS

Figure 1:
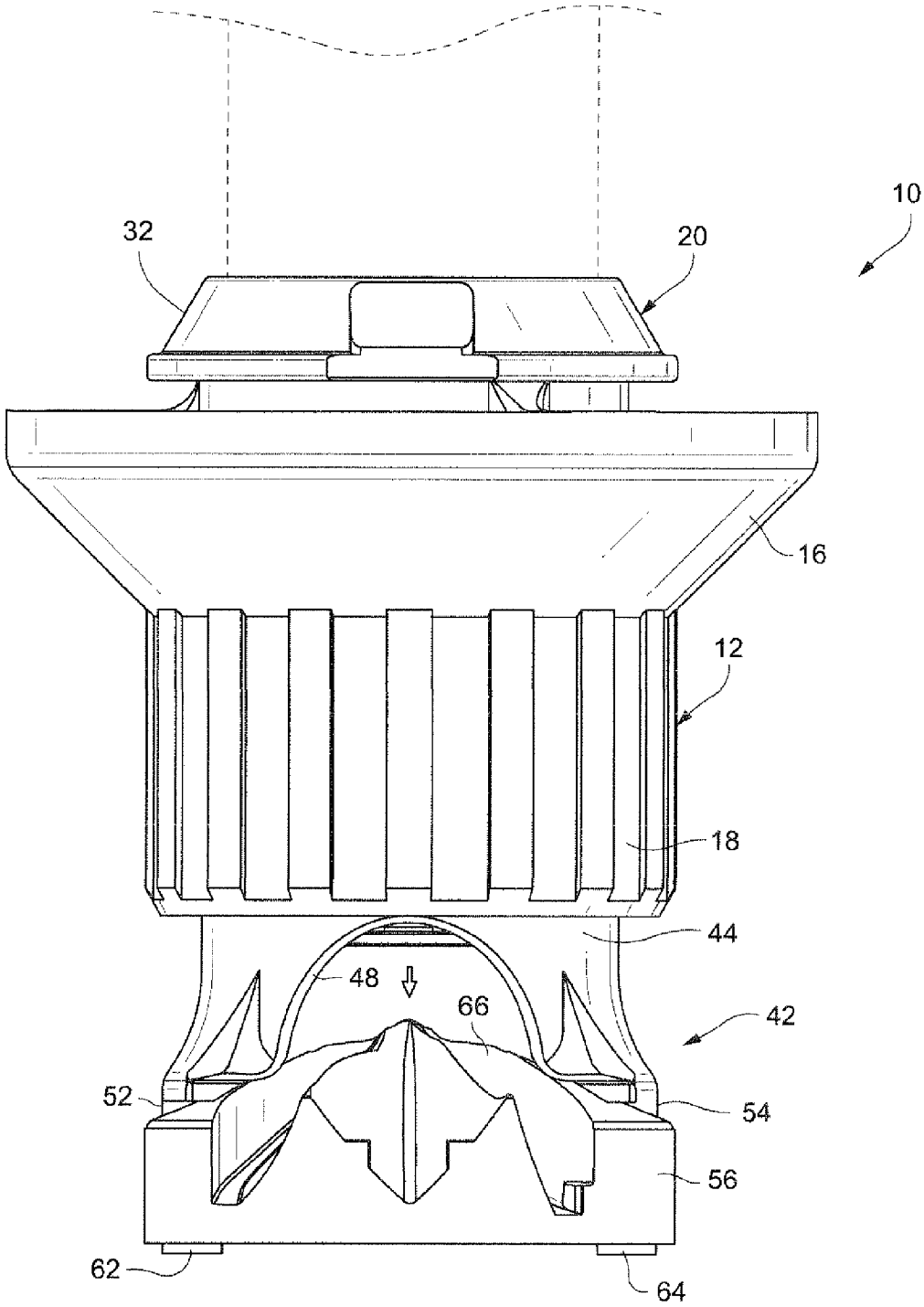
FIG. 1 is a side elevation of a sprinkler in accordance with a first exemplary but nonlimiting embodiment.
Figure 2:
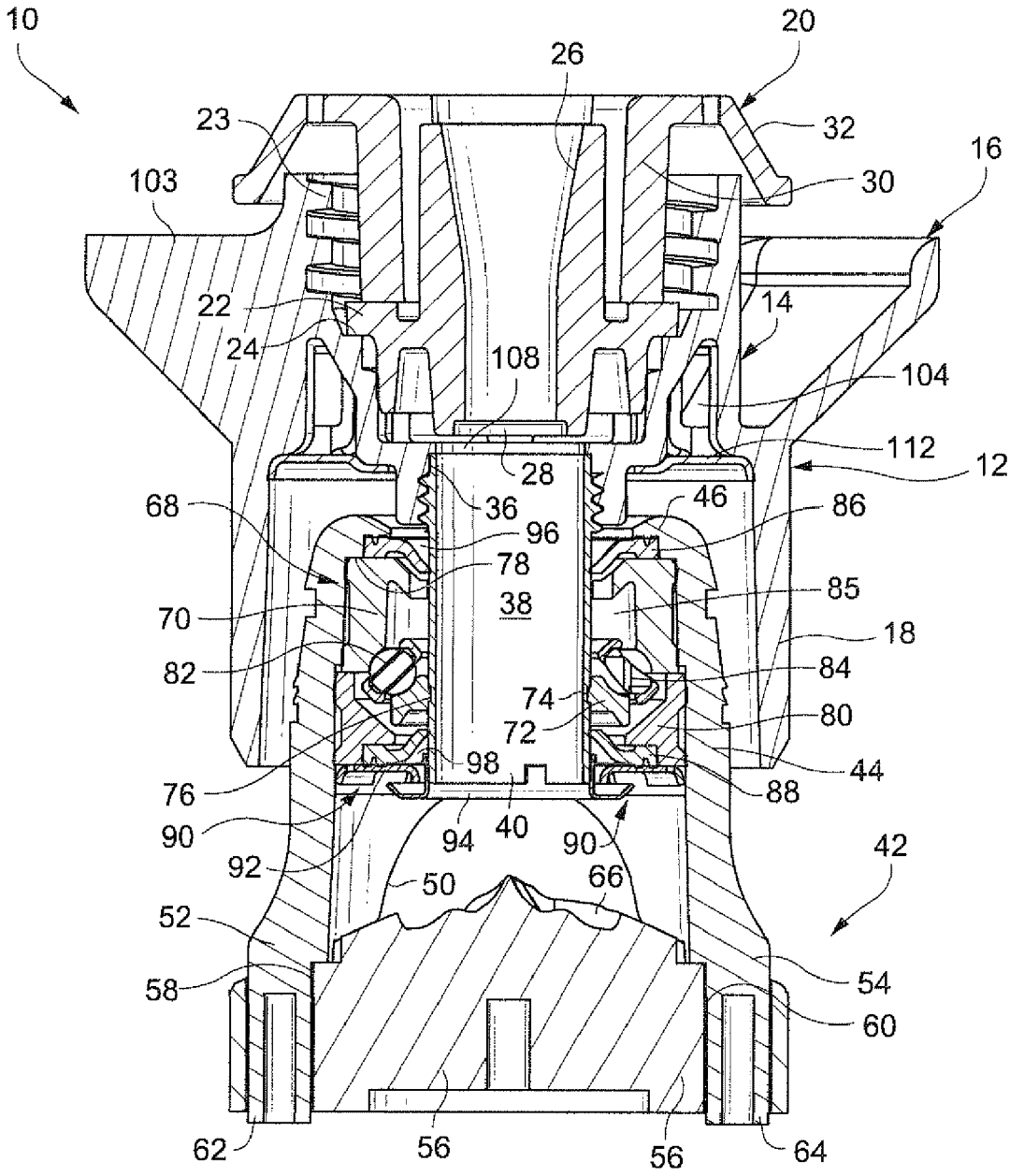
FIG. 2 is a longitudinal cross section of the sprinkler shown in FIG. 1.
Figure 3:
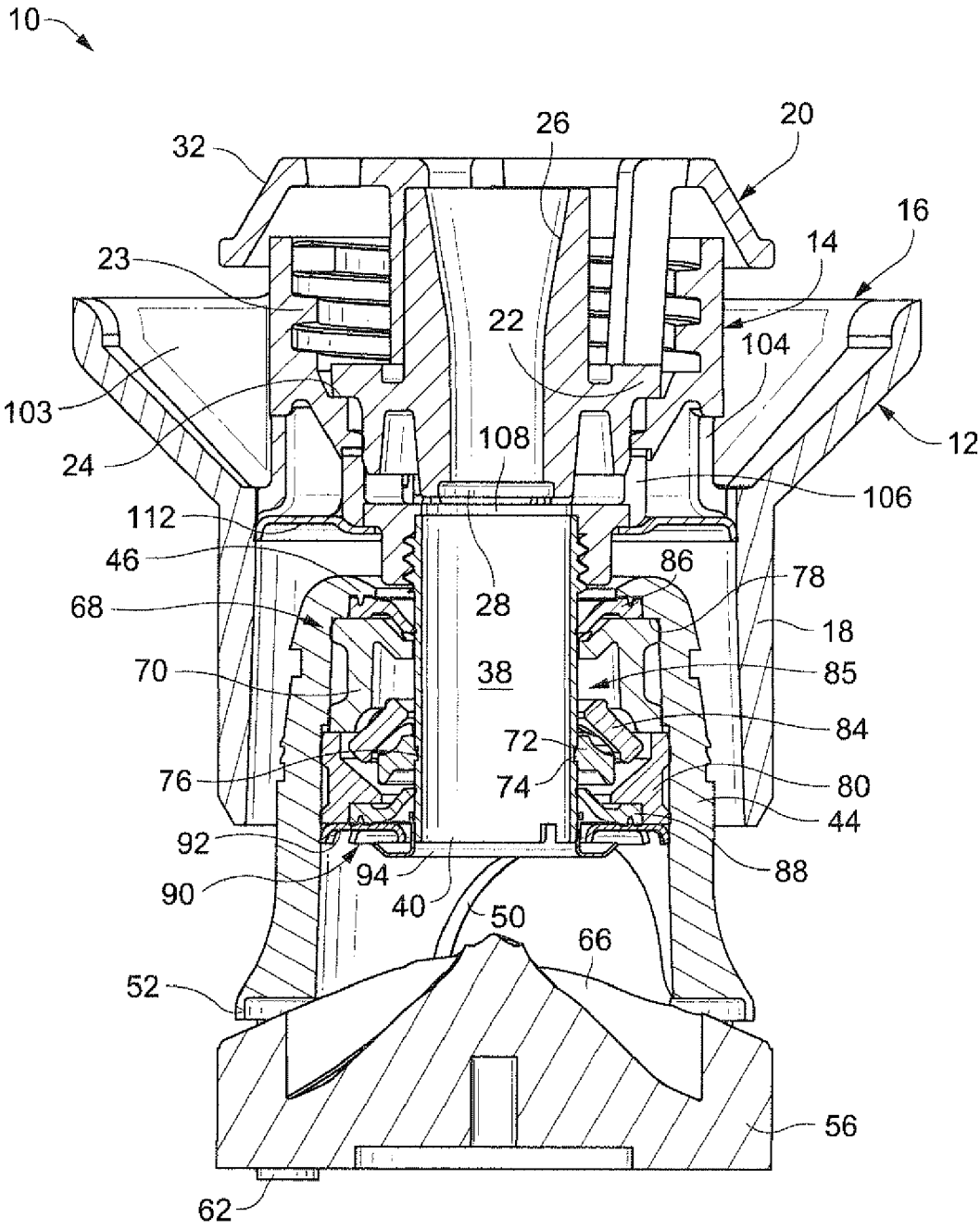
FIG. 3 is a cross section similar to FIG. 2, but with the sprinkler rotated about its longitudinal axis about 30 degrees.
Figure 4:
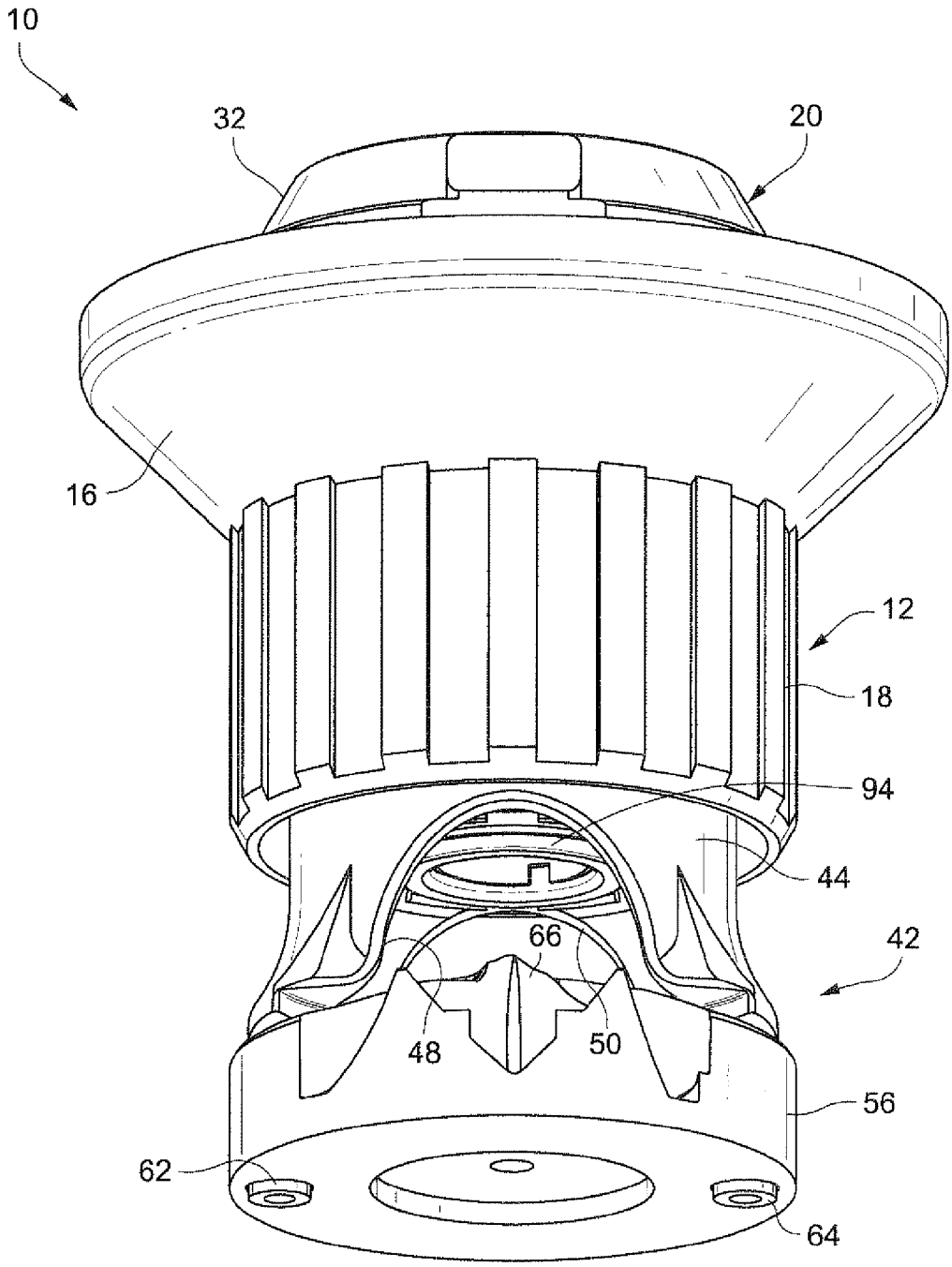
FIG. 4 is a lower perspective view of the sprinkler shown in FIG. 1.
Figure 5:
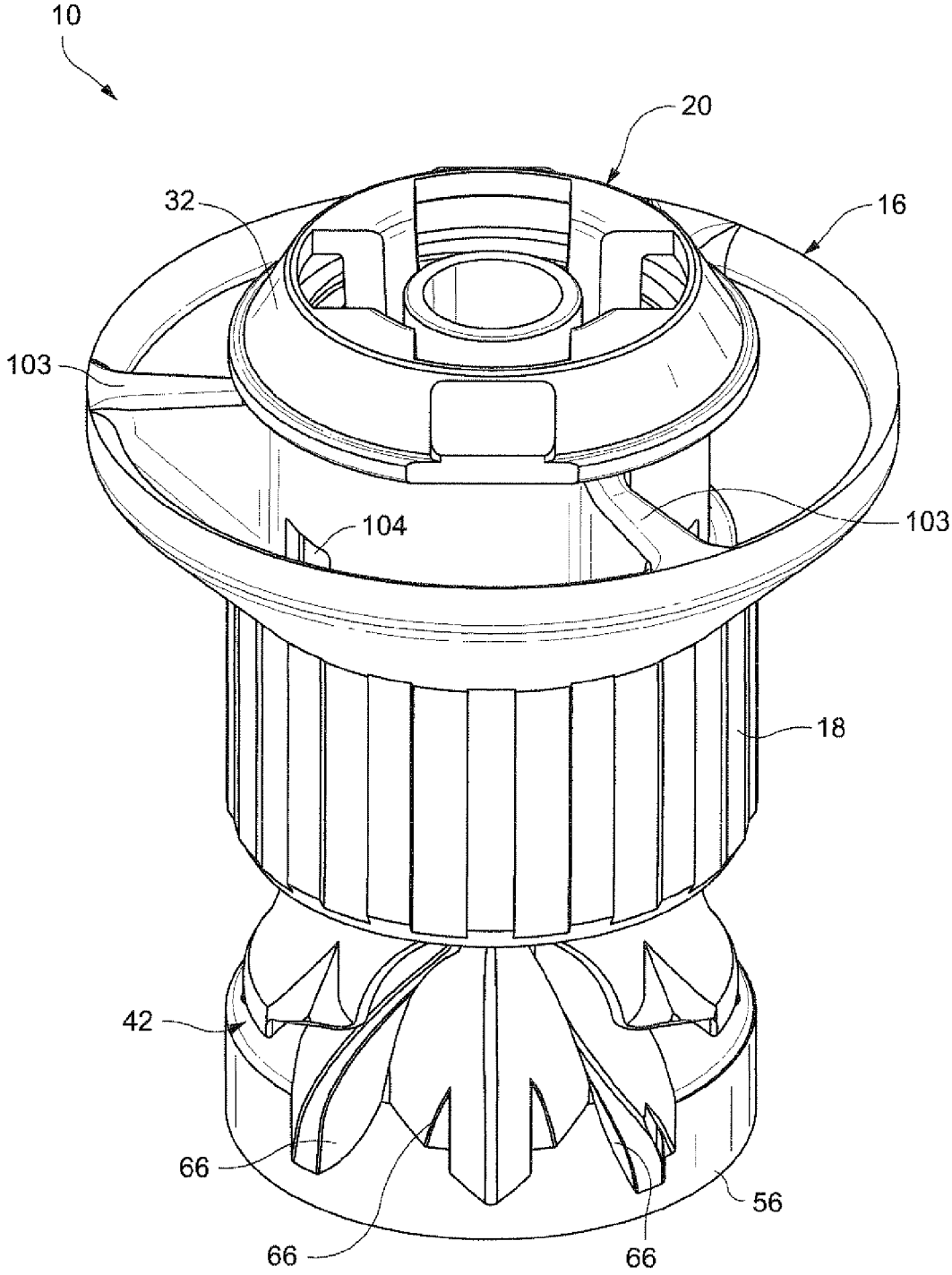
FIG. 5 is an upper perspective view of the sprinkler shown in FIGS. 1 and 4.
Figure 6:
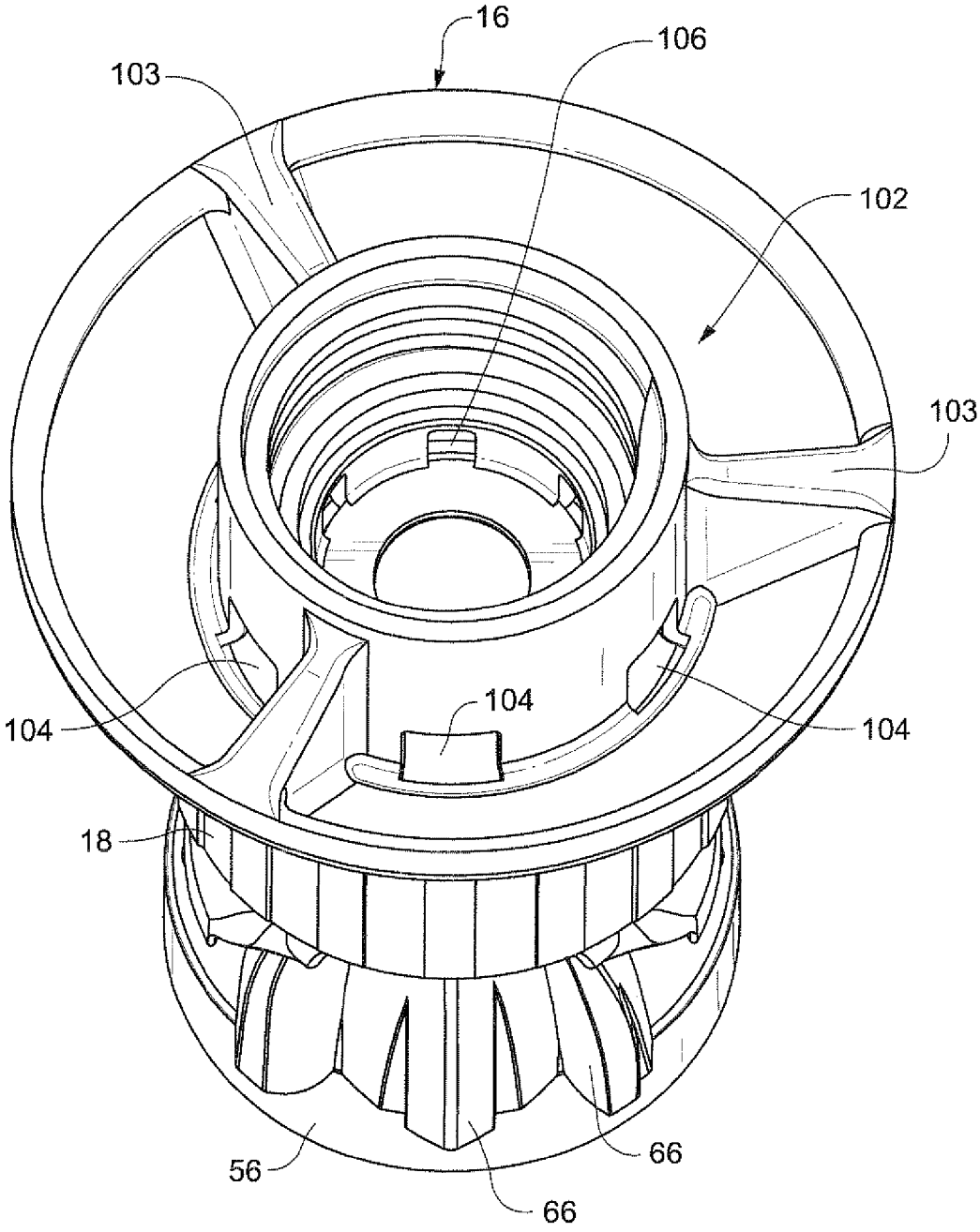
FIG. 6 is a perspective view generally similar to FIG. 5, but with the sprinkler nozzle removed to show internal portions of the sprinkler housing.

With reference initially to FIGS. 1-3, a dripless rotary sprinkler 10 in accordance with a first exemplary embodiment is illustrated. The sprinkler 10 is typically attached to the lower end of a drop hose or the like on an irrigation machine, with water flowing through the sprinkler in a downward direction. The sprinkler includes a housing 12 formed with an upper, internal cylindrical housing portion 14 (FIGS. 2 and 3), surrounded by a collection funnel 16 and a depending protective skirt portion 18. A nozzle body 20 is supported within the upper, internal cylindrical housing portion 14, with an outer annular flange 22 seated on an internal horizontal shoulder or step 24 formed within the upper housing portion. It may be appreciated that the nozzle body 20 is held within the housing by an adapter (not shown) threadably connected to the housing 12 by means of threads 23. The manner in which the adapter engages and holds the nozzle within the sprinkler housing is conventional and is illustrated and described in, for example, commonly owned U.S. Pat. No. 5,415,348. The nozzle body 20 is formed with an inner tapered portion 26 that terminates in a downstream direction at the orifice 28. A radially outer tubular portion 30 extends in an upstream direction to a conical ring flange 32 that is visible to the user, and that may have nozzle size and/or performance information thereon. It will be appreciated that the nozzle body 20 is easily removed and replaced by the same or different-size nozzle, simply by unscrewing the adapter and lifting the nozzle out of the housing 12.

The housing 12 is also formed with an inner, threaded center opening 36 which receives the upper end of a correspondingly threaded cylindrical nozzle tube 38. It will be appreciated that the nozzle tube 38 is axially aligned with the nozzle orifice 28, but with a slight axial gap 108 (FIG. 2) therebetween, the purpose for which will be described further herein. Thus, water flowing through the nozzle body 20 will exit the orifice 28 and then flow through the nozzle tube 38 to exit the tube outlet 40.

A water-distribution (or water-deflection) plate assembly 42 is supported on the nozzle tube 38. More specifically, the water-deflection plate assembly 42 includes a tubular support 44 formed at its upper end with a radially inwardly directed flange 46. The lower portion of the tubular support is cut away to form a pair of diametrically-opposed, arched openings 48, 50. Diametrically-opposed bosses 52, 54 extend from the bottom of the solid portion of the tubular support, and receive the water-deflection plate 56. Specifically, the water-deflection plate 56 is provided with a pair of apertures 58, 60 through which the bosses 52, 54 pass, with the remote ends 62, 64 heat-staked (see FIGS. 1 and 2) or otherwise secured to the water-deflection plate 56. It will be appreciated that, in an exemplary alternative, the bosses 52, 54 may be internally threaded and screws used to secure the water-deflection plate 56 to the tubular support 44.

Grooves 66 are formed in the water-deflection plate 56 and are circumferentially curved such that water impinging on the water-deflection plate 56 will cause the entire water-deflection plate assembly 42 to rotate about the longitudinal axis of the sprinkler, relative to the nozzle tube 38 and housing 12.

In order to effect this relative rotation, a ball-bearing assembly 68 is located within the tubular support 44. The assembly 68 includes an upper, rotatable annular race 70 and a lower, stationary annular race 72. Note that the lower race 72 is press-fit on the nozzle tube 38, with an annular rib 74 engaged in an annular groove 76 in the nozzle tube 38. The upper, annular race 70 engages an annular shoulder 78 formed in the tubular support 44, and an annular spacer 80 engages the lower end of the upper race and holds the upper race in place. Bearing balls 82 are located between the upper and lower races 70, 72, in an annular separator 84 that maintains the bearing balls 82 in a circumferentially-spaced relation to each other. The engagement surfaces of the respective races are aligned at an acute angle (for example, 450) to vertical, thus enabling the ball-bearing assembly to function as both a radial and thrust bearing.

Annular lip seals 86, 88 engage the nozzle tube 38 and seal the area along the nozzle tube which encompasses the ball-bearing assembly 68. An outer retainer ring 92, press-fit into the tubular support 44, holds the ball-bearing assembly within the tubular support 44. A shield 94 inserted into the lower end of the nozzle tube 38 prevents water and debris from reaching the seal 88.

In order to slow rotation of the water-deflection plate 56, the area between lip seals 86 and 88 (defining a closed chamber 85) is substantially filled with a viscous fluid such as silicone. This creates a viscous shearing action between the upper race 70 and the nozzle tube 38, as well as between the bearing balls 82, separator 84 and lower race 72.

In addition, pockets 96 and 98 on the exterior sides of the lip seals 86, 88 may be filled with grease to prevent ingress of dust, dirt or debris which might otherwise work its way past the lip seals 86, 88 and into the ball-bearing assembly 68. The depending protective skirt portion 18 of the housing 12 substantially encloses the upper end of the tubular support 44, thus offering a further degree of protection.

With this arrangement, the water-deflection plate assembly 42 will rotate relative to the housing 12 and relative to the nozzle tube 38, with the speed of rotation slowed not only by the viscous fluid within the chamber 85, but also by reason of the mechanical friction generated by the bearing balls 82 relative to the fixed lower race 72 and separator 84. In this regard, the separator 84 may be formed with oval-shaped openings or apertures 100 (see separator 172 in FIG. 9) for receiving the bearing balls 82. The oval shape may be employed where it is desired to adjust the braking forces due to friction. In other words, if the braking action is too great, an adjustment can be made in the shape of the apertures 100 to increase the speed of rotation of the water-deflection plate assembly 42. Making the apertures oval-shaped reduces the contact surface area with the bearing balls, and hence reduces mechanical friction.

Significantly, the ball-bearing assembly 68 also reduces the amount of friction due to the thrust load generated by the stream impinging on the water-deflection plate 56. In contrast, for a relatively large diameter tubular support 44, there would be too much friction on a simple thrust washer. In addition, by configuring the ball-bearing assembly as an angular contact bearing (by angularly offsetting the ball-engaging surfaces of the upper and lower bearing races), combined thrust and radial bearing functions are provided in a single bearing assembly. Note that the angular contact bearing is also a self-centering bearing in that, as the thrust load increases, the bearing will move to center and thus improve the concentricity of the rotating water-deflection plate assembly 42 relative to the nozzle tube 38.

Another feature relates to the rotation of the tubular support 44 with the water-deflection plate 56. Because the water-deflection plate 56 rotates with the tubular support 44, there is no concern for the emitted stream breaking up as it crosses one or more stationary plate support struts. Note also that the grooves 66 (which may each have a different performance configuration for stream range, width or for torque generation) are arranged to direct the streams through the arched openings 48, 50, i.e., there are no grooves that would cause a stream to be directed against the solid portions of the tubular support 44, circumferentially between the arched openings.

Another feature of the invention relates to the handling of excess water, or "drool", which may flow downward along the adapter and onto the sprinkler. To this end, the collection funnel 16 extends upwardly and outwardly to form a water collection trough 102 around the skirt portion 18 of the housing and serves to collect the aforementioned excess water or drool. The collection funnel 16 is reinforced by plural radial webs 103. Water collected in the trough 102 will flow through one or more drain apertures 104 at the base of the trough and 106 axially adjacent the center opening 36 and radially adjacent the axial gap 108 between the nozzle orifice 28 and the nozzle tube 38. The excess water or drool is thus aspirated (or drawn) into the water stream exiting the nozzle orifice 28 and flowing through the nozzle tube 38. The excess water or drool is subsequently redirected outwardly in a radial pattern by the water-deflection plate 56. An annular plate seal 112 (shown in FIGS. 2 and 3) press-fit into the housing from below prevents the excess water or drool from simply dripping into the area between the skirt 18 and the upper portion of the tubular support 44.

Figure 7:
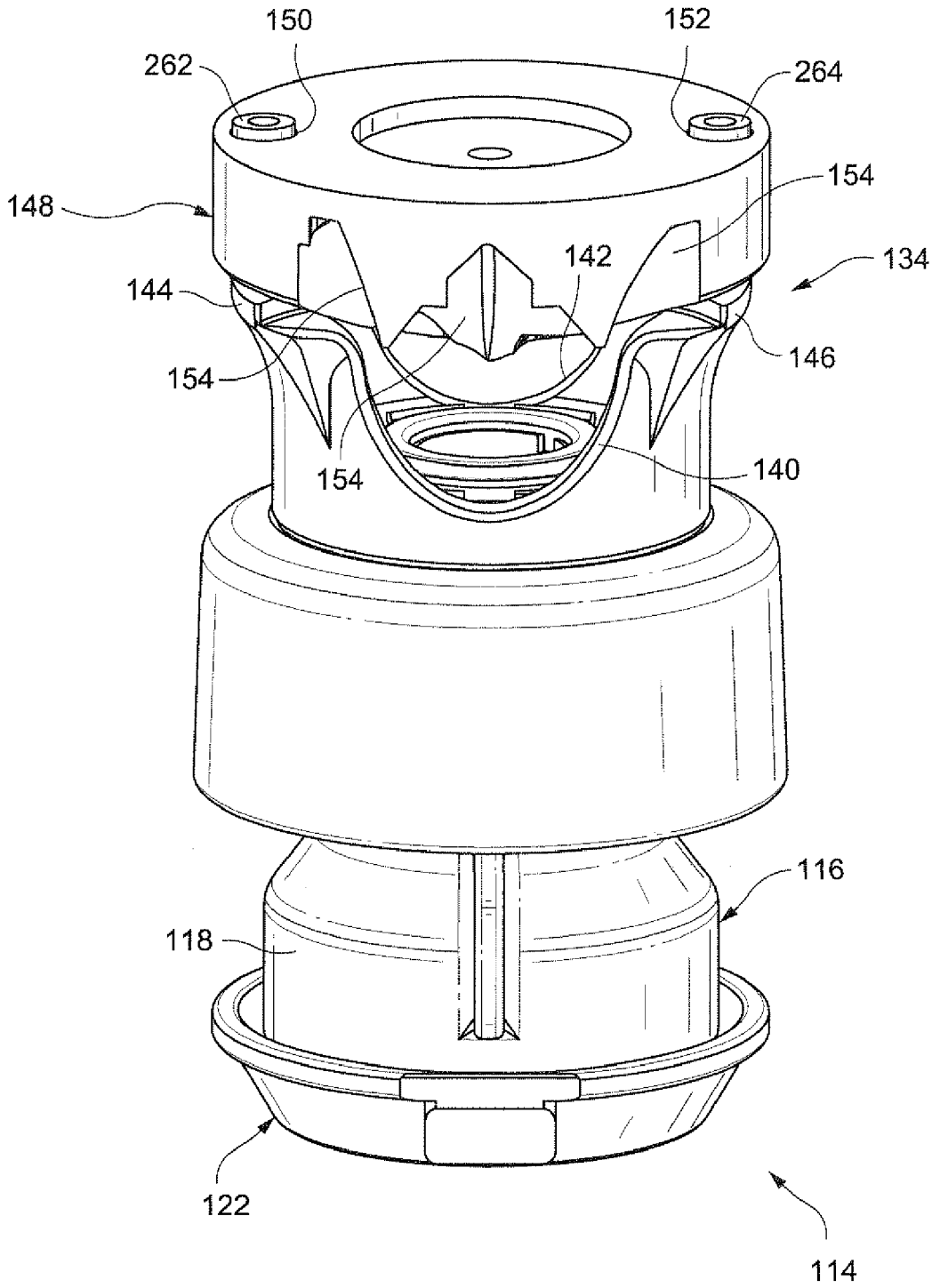
FIG. 7 is a perspective view of a sprinkler in accordance with a second exemplary but nonlimiting embodiment.
Figure 8:
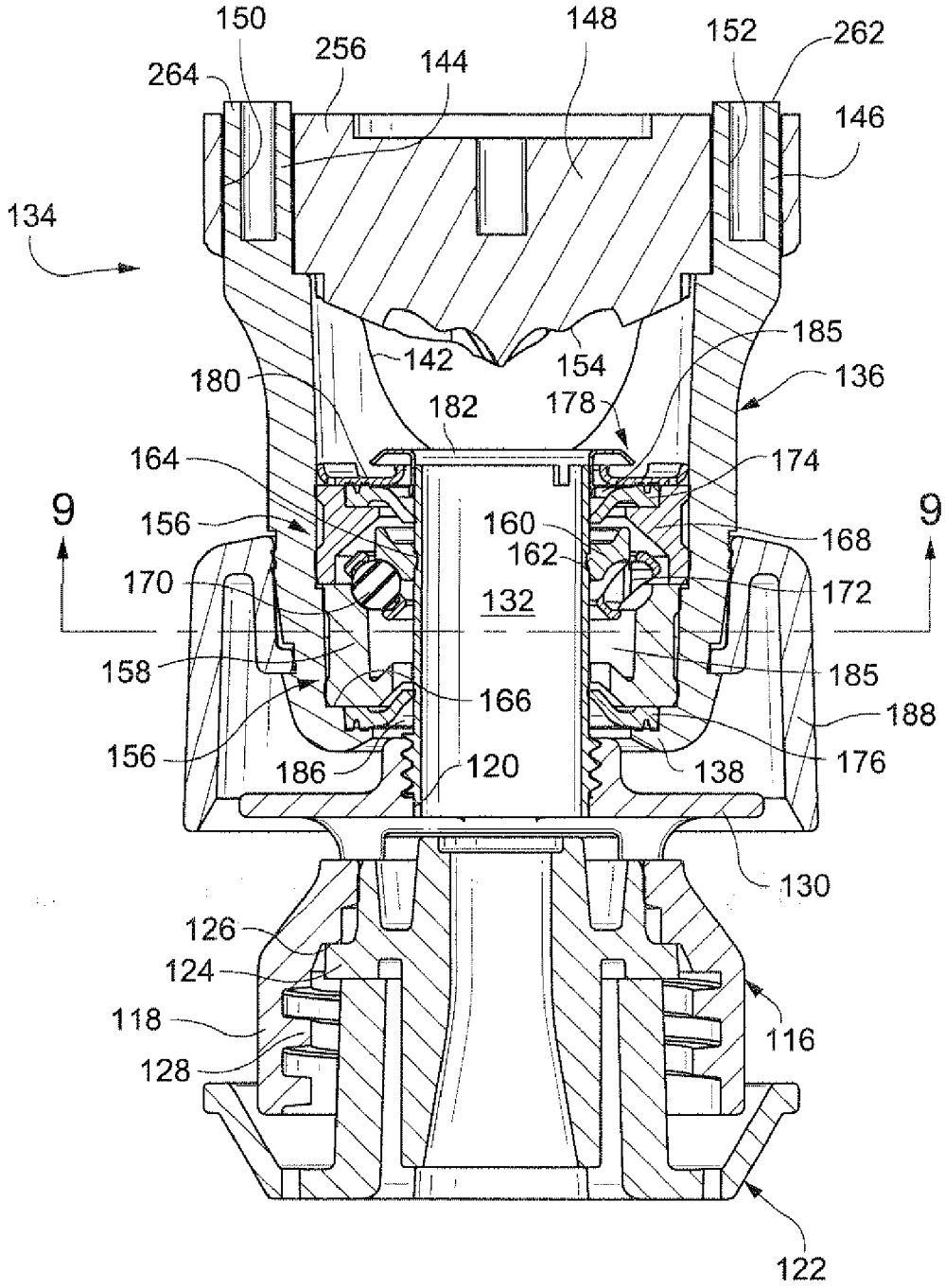
FIG. 8 is a longitudinal cross section of the sprinkler shown in FIG. 7.
Figure 9:
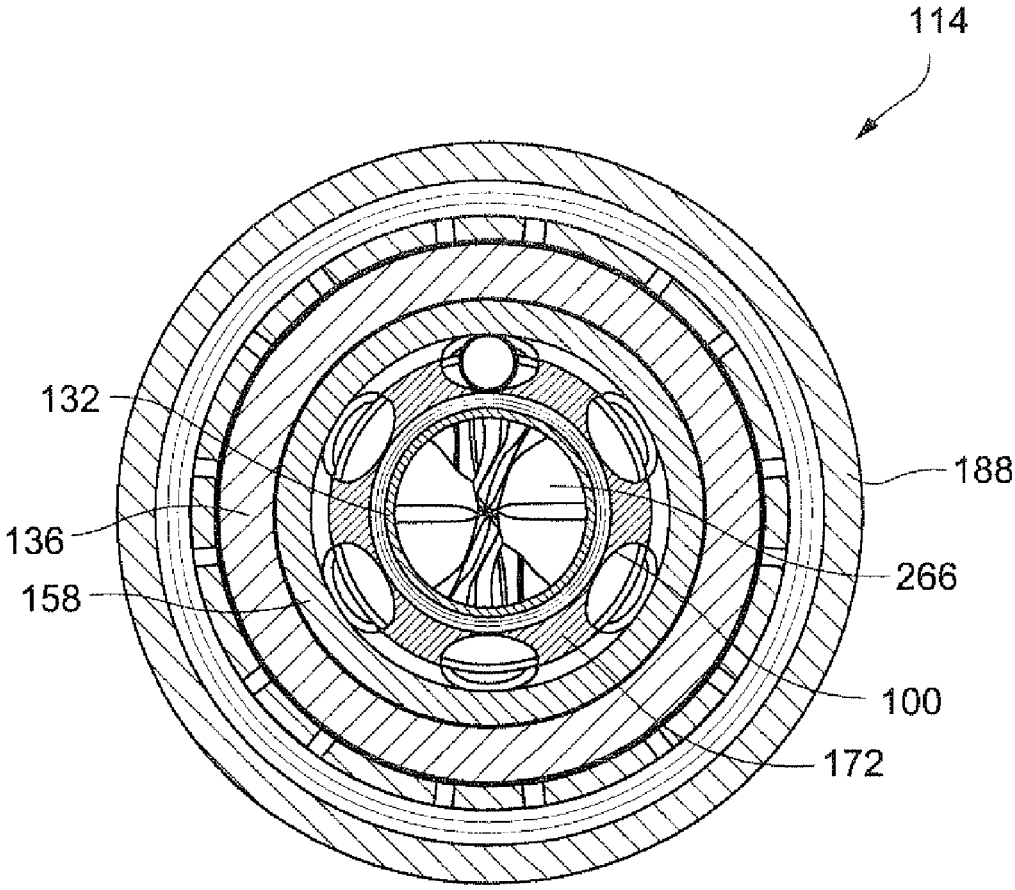
FIG. 9 is a section view taken along the line 9-9 in FIG. 8.

Turning now to FIGS. 7-9, another exemplary embodiment of the invention is illustrated. Here, the sprinkler is intended to be used inverted relative to the orientation of the sprinkler shown in FIGS. 1-6. In other words, the sprinkler would typically be mounted atop a riser, and the stream emitted from the nozzle projects vertically upwardly and is then thrown radially outwardly by the water-deflection plate 148. While the sprinkler drive and braking functions are similar, there is no need for a collection funnel.

In this second exemplary embodiment, the rotary sprinkler 114 includes a housing 116 formed with a substantially lower cylindrical housing portion 118, and an upper threaded center opening 120. The nozzle body 122 is supported within the lower cylindrical housing portion 118, with an outer annular nozzle flange 124 engaged with an internal horizontal shoulder or step 126 formed within the lower cylindrical housing portion 118. It may be appreciated that the nozzle body 122 is again held within the housing by an adapter (not shown) threadably connected to the housing 116 by means of threads 128. The nozzle body 122, aside from being inverted relative to its orientation in FIGS. 1-6, is identical to the nozzle body 20.

The threaded center opening 120 is surrounded by a horizontal radial flange 130 and receives the lower end of a correspondingly threaded cylindrical nozzle tube 132. The water-deflection plate assembly 134 is supported on the nozzle tube 132. More specifically, the water-deflection plate assembly 134 includes a tubular support 136 formed at its lower end with a radially inwardly directed flange 138. The upper portion of the tubular support 136 is cut away to form a pair of diametrically-opposed, arched openings 140, 142. Diametrically-opposed bosses 144, 146 extend from the top of the solid portions of the tubular support 136, and receive the water-deflection plate 14*a*. The water-deflection plate 148 is also provided with a pair of apertures 150, 152 through which the bosses 144, 146 pass, with the remote ends 262, 264 heat-staked or otherwise secured to the water-deflection plate 148.

Grooves 154 are formed in the water-deflection plate 148 and are circumferentially curved such that water impinging on the water-deflection plate 148 will cause the entire water-deflection plate assembly 134 to rotate about the longitudinal axis of the sprinkler, and relative to the nozzle tube 132 and housing 116.

The relative rotation between the tubular support 136 and water-deflection plate 148 on the one hand, and housing 116 on the other, is affected as described hereinabove in connection with FIGS. 1-6. Specifically, a hall-bearing (or angular contact bearing) assembly 156 is located within the tubular support 136. The ball-bearing assembly 156 includes a lower, rotatable annular race 158 and an upper, stationary annular race 160, arranged as in the previously-described embodiment. The upper race 160 is press-fit on the nozzle tube 132, with an annular rib 162 engaged in an annular groove 164 in the nozzle tube 132. The lower, rotatable annular race 158 is seated on an annular shoulder 166 formed in the tubular support 136, and an annular spacer 168 engages the upper end of the lower race and holds the lower race in place. Bearing balls 170 (one shown in FIG. 8) are located between the upper and lower races 158, 160, and the annular separator 172 maintains the bearing balls in circumferentially-spaced relation to each other.

Annular lip seals 174, 176 engage the nozzle tube 132 and seal the area along the nozzle tube which encompasses the ball-bearing assembly 156, and an outer retainer ring 180 press-fit into the tubular support 136, holds the ball-bearing assembly within the tubular support 136. A shield 182 located on the upper end of the nozzle tube 132 protects the seal 174 from water and debris.

The area between lip seals 174 and 176 (defining a closed chamber 185) is substantially filled with a viscous fluid such as silicone to create a braking effect as described above.

As in the previous embodiment, pockets 184 and 186 on the exterior side of the lip seals 174, 176 may be filled with grease to prevent ingress of dust, dirt or debris which might otherwise work its way past the lip seals 174, 176 and into the ball-bearing assembly 156. In this second embodiment, a protective skirt 188 may be snap-fit, threaded, or otherwise suitably secured to the tubular support 136 and, together with the radial flange 130 on the housing 116, substantially enclose the lower end of the tubular support 136.

As in the first-described embodiment, the water-deflection plate assembly 134 will rotate relative to the housing 116 and relative to the nozzle tube 132, with the speed of rotation slowed not only by the viscous fluid within the chamber 185, but also by reason of the friction generated by the bearing balls 170 relative to the fixed upper race 160 and separator 172. As previously noted and as seen in FIG. 9, the separator 172 may be formed with oval-shaped apertures 100 for receiving the bearing balls 170 when braking action is to be reduced.

As in the previous embodiment, because the water-deflection plate 148 rotates with the tubular support 136, there is no concern for the emitted stream breaking up as it crosses one or more stationary plate support struts. The grooves 154 and their orientation relative to the arched openings 140, 142, remain as described in connection with the first embodiment.

It will be understood that for both embodiments, the viscosity of the fluid in the chambers, 85, 185 the shape of the apertures 100 used in the ball separators 84, 172 and the number of bearing balls 82, 170 used in the ball-bearing assemblies 68, 156 may be varied as necessary to achieve the desired braking action.

Figure 10:
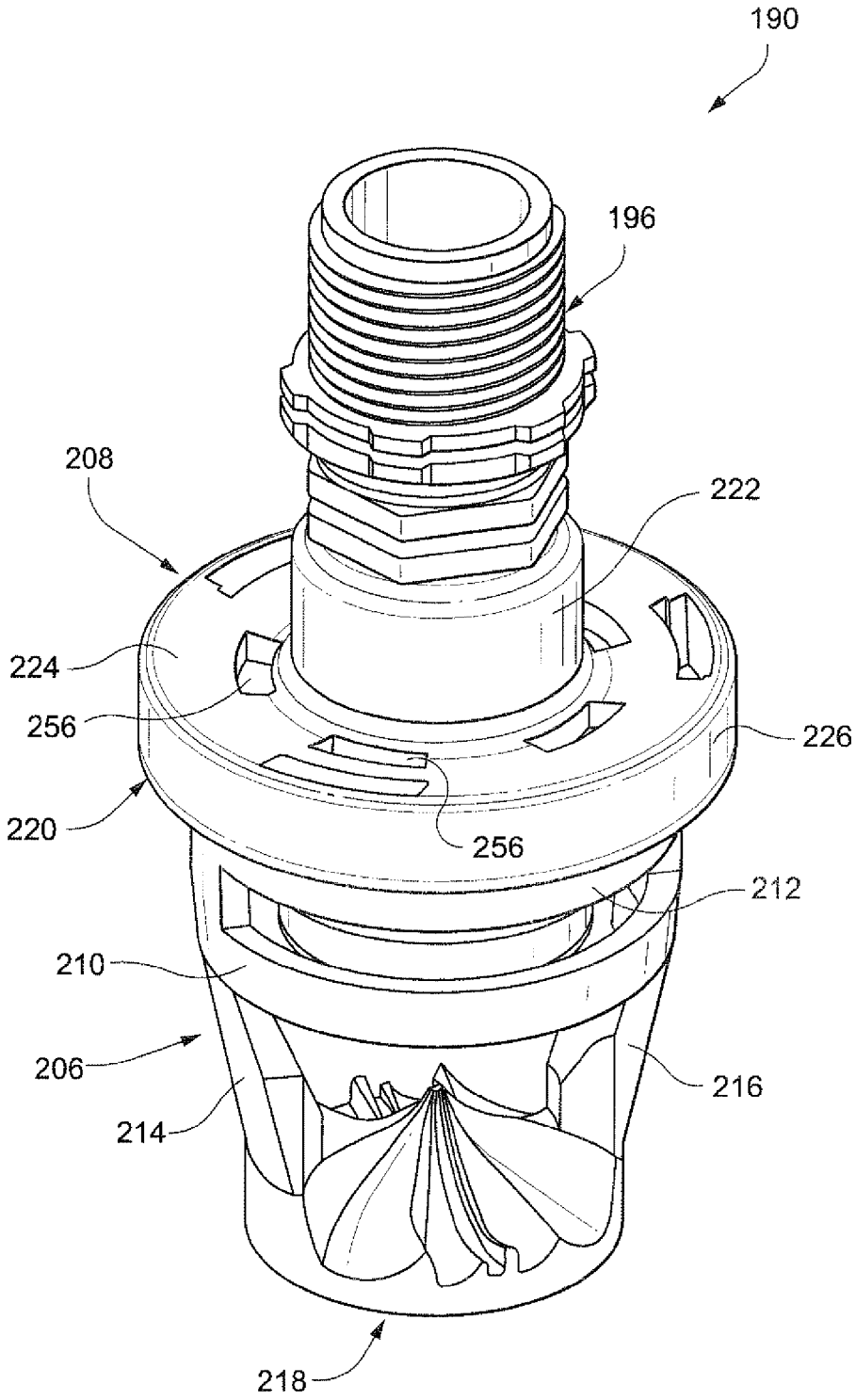
FIG. 10 is a perspective view of a sprinkler in accordance with a third exemplary but nonlimiting embodiment of the invention.
Figure 11:
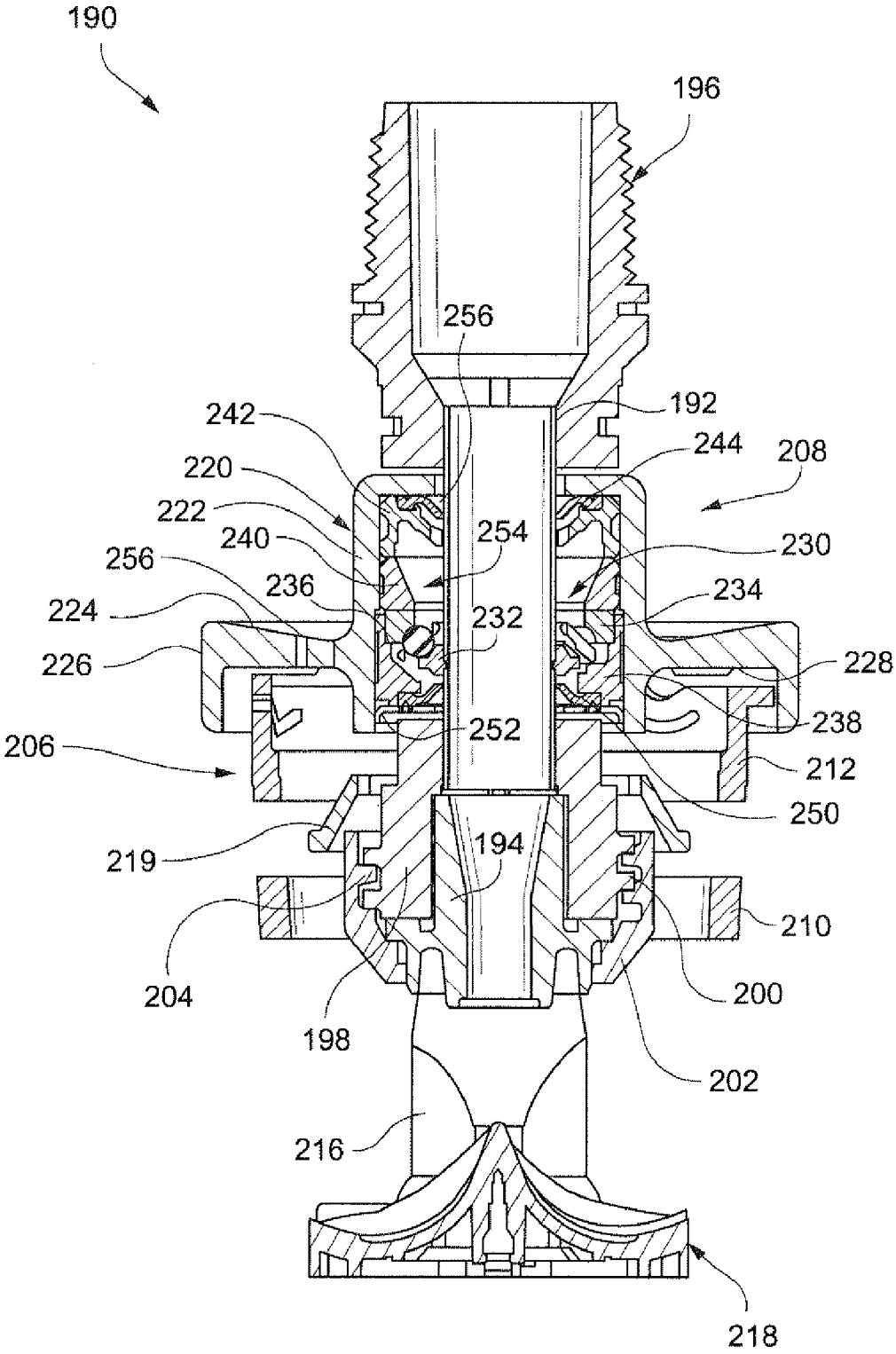
FIG. 11 is a cross section of the sprinkler shown in FIG. 10.

Turning to FIGS. 10 and 11, another embodiment is illustrated that has an operating orientation similar to the embodiment shown in FIGS. 1-6 but with structural differences noted below. The sprinkler 190 is configured to have the nozzle tube 192 (FIG. 11) upstream of the nozzle 194 unlike the embodiment in FIGS. 1-6 where the nozzle tube 38 is downstream of the nozzle body 20.

More specifically, the nozzle tube 192 is press-fit into the adapter 196 by which the sprinkler 190 is attached to a water supply hose, tube, or other device such as a water pressure regulator (not shown). The opposite end of the nozzle tube receives a cylindrical hub or fitting 198 provided with threads 200. The nozzle 194 (identical to the nozzle bodies 20 and 122) slides onto the fitting 198 and is secured by a retaining nut 202 provided with threads 204 that engage the threads 200. This assembly of the nozzle tube 192, nozzle 194, fitting 198 and retaining nut 202 is received centrally within the sprinkler body or cage 206 and attached cap and brake assembly 208. The sprinkler body or cage 206 is comprised of lower and upper, vertically-spaced annular rings 210 and 212, connected by diametrically-opposed, vertically-oriented struts 214, 216 that extend beyond the lower ring 210 and support the spray plate 218. The spray plate 218 may be secured to the struts 214, 216 as in the previously-described embodiments. Note that the arrangement of rings 210, 212 and struts 214, 216 define cut-outs or apertures which allow visual access to the nozzle identifier flange 219 (FIG. 11).

The cap and brake assembly 208 includes a cap 220 formed with a centrally-located motor housing 222 surrounded by a radial flange 224 terminating at a peripheral skirt 226. It will be appreciated that the cap and brake assembly 208 may be secured to the sprinkler body or cage 206 by any suitable means such as a snap or bayonet fit, with the attachment features located in the peripheral channel 228 on the underside of the flange 224.

The relative rotation between the fixed nozzle tube 192 and nozzle 194 on the one hand, and the rotatable sprinkler body or cage 206 and water-deflection or spray plate 218 on the other is effected as in the previously-described embodiments. Specifically, a ball-bearing (or angular contact bearing) assembly 230 is located within the motor housing 222 and includes a lower, fixed annular race 232 and an upper, rotatable annular race 234, arranged substantially as in the previously-described embodiments. The lower race 232 is press or snap-fit onto the nozzle tube 192. The upper, rotatable annular race 234 is sandwiched between an annular shoulder 236 formed in a first annular spacer 238 and the underside of a second annular spacer 240 press-fit within the motor housing 222. A third annular spacer 242 is seated atop the second annular spacer 240 and supports an upper lip seal 244. The lower end of the first annular spacer 238 provides a seat for a lower lip seal 250, and a retainer plate 252 holds the lower seal in place.

The annular lip seals 244, 250 engage the nozzle tube 192 and seal the area along the nozzle tube which encompasses the ball-bearing assembly 230. The area between lip seals 244 and 250 define a substantially closed and sealed chamber 254 that is substantially filled with a viscous fluid such as silicone to create a braking effect as described above.

As in the previous embodiments, at least the pocket 258 on the exterior side of the upper lip seal 244 may be filled with grease to prevent ingress of dust, dirt or debris which might otherwise work its way past the lip seal 244 and into the ball-bearing assembly 230. In this third embodiment, the proximity of the hub or fitting 198 to the lower lip seal 250 effectively prevents entry of any dirt or debris into the brake housing from below.

In this third exemplary but nonlimiting embodiment, the radial flange 224 is angled downwardly in a radial inward direction to funnel any excess water from the adapter 196 (or hose or other component above the adapter) into and through a plurality of drain holes 256 arrayed about the motor housing 222. This excess water will then fall onto the nozzle flange 219 and then onto the spray plate 218 from which it will be expelled outwardly with the water streams originating from the nozzle 194.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A rotary sprinkler comprising:

a housing supporting a nozzle and a nozzle tube, said nozzle tube located axially adjacent an orifice of said nozzle with an axial gap therebetween;

a water-deflection plate assembly carried by said nozzle tube for rotation relative to said nozzle tube;

wherein said housing is formed with an exterior substantially annular funnel surrounding said nozzle and at least a portion of said housing and forming a collection trough for collection of excess water on an outside surface of said housing, said housing formed with one or more apertures directing excess water in said collection trough to an internal area surrounding said orifice, thereby allowing excess water to be aspirated through said gap into a stream of water emitted from said nozzle orifice and through said nozzle tube, such that the excess water is distributed by said water-deflection plate along with water emitted from the nozzle orifice.

2. The rotary sprinkler of claim 1 wherein said water-deflection plate assembly includes a support mounting a water-deflection plate at one end thereof, an opposite end of said support rotatably secured on said nozzle tube.

3. The rotary sprinkler of claim 2 wherein said support is rotatably secured on said nozzle tube by a ball-bearing assembly located in a chamber radially between said nozzle tube and said support, said ball-bearing assembly comprising a first race fixed to said nozzle tube and a second race fixed to said support for rotation therewith; a plurality of bearing balls located between said first and second races; and a pair of seals at opposite ends of the ball-bearing assembly.

4. The rotary sprinkler of claim 3 wherein said chamber is substantially filled with a viscous fluid.

5. The rotary sprinkler of claim 4 wherein said viscous fluid comprises silicone.

6. The rotary sprinkler of claim 3 wherein said bearing balls are held within oval-shaped apertures in an annular ring separator located between said first and second races.

7. The rotary sprinkler of claim 2 wherein said support is substantially tubular and wherein water-deflection plate is formed with at least first and second substantially diametrically-opposed, radially-extending grooves, in radial alignment with respective diametrically-opposed openings formed in said tubular support.

8. The rotary sprinkler of claim 3 wherein pocket areas on external sides of said seals are packed with grease.

9. The rotary sprinkler of claim 1 wherein said housing further comprises a depending skirt portion substantially enclosing said nozzle tube and an upper portion of said support.

10. A rotary sprinkler comprising:

a housing supporting a nozzle and a nozzle tube, said nozzle tube located axially adjacent an orifice of said nozzle;

a water-deflection plate assembly carried by said nozzle tube for rotation relative to said nozzle tube;

wherein said water-deflection plate assembly includes a support mounting a water-deflection plate at one end thereof, an opposite end of said support rotatably secured on said nozzle tube; and further wherein said support is rotatably secured on said nozzle tube by a ball-bearing assembly located in a chamber radially between said nozzle tube and said support, wherein said ball-bearing assembly comprises a first race fixed to said nozzle tube and a second race fixed to said support for rotation therewith; a plurality of bearing balls located between said first and second races, said first and second races having ball-engaging surfaces aligned at an acute angle to vertical; a pair of seals at opposite ends of said ball-bearing assembly.

11. The rotary sprinkler of claim 10 wherein said chamber is substantially filled with a viscous fluid.

12. The rotary sprinkler of claim 11 wherein said viscous fluid comprises silicone.

13. The rotary sprinkler of claim 10 and further comprising wherein said ball-bearing assembly comprises a first race fixed to said nozzle tube and a second race fixed to said support for rotation therewith; a plurality of bearing balls located between said first and second races, said first and second races having ball-engaging surfaces aligned at an acute angle to vertical; a pair of seals at opposite ends of said ball-bearing assembly.

14. The rotary sprinkler of claim 10 wherein said bearing balls are held within apertures in an annular ring separator located between said first and second races.

15. The rotary sprinkler of claim 10 wherein said support is substantially tubular and wherein water-deflection plate is formed with at least first and second substantially diametrically-opposed, radially-extending grooves, in radial alignment with respective diametrically-opposed openings formed in said tubular support.

16. The rotary sprinkler of claim 10 wherein pocket areas provided on external sides of said seals are packed with grease.

17. The rotary sprinkler of claim 15 wherein a sleeve fixed to said tubular support surrounds a portion of said tubular support which encloses said ball-bearing assembly.

18. The rotary sprinkler of claim 17 wherein said housing includes a radial flange substantially aligned with and received in a free end of said sleeve.

19. The rotary sprinkler of claim 14 wherein said apertures are oval-shaped.

20. The rotary sprinkler of claim 10 wherein said acute angle is 45°.

* * * * *